US011323811B2

(12) United States Patent
Miyasaka

(10) Patent No.: US 11,323,811 B2
(45) Date of Patent: May 3, 2022

(54) ACOUSTIC DEVICE AND ACOUSTIC REPRODUCTION METHOD FOR PRODUCING HIGH QUALITY BASS SOUND

(71) Applicant: SOCIONEXT INC., Kanagawa (JP)

(72) Inventor: Shuji Miyasaka, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 17/210,387

(22) Filed: Mar. 23, 2021

(65) Prior Publication Data

US 2021/0211804 A1 Jul. 8, 2021

Related U.S. Application Data

(63) Continuation of application No. PCT/JP2018/037088, filed on Oct. 3, 2018.

(51) Int. Cl.
*H04R 3/04* (2006.01)
*H04R 1/22* (2006.01)

(52) U.S. Cl.
CPC ..... *H04R 3/04* (2013.01); *H04R 1/22* (2013.01)

(58) Field of Classification Search
None
See application file for complete search history.

(56) References Cited

U.S. PATENT DOCUMENTS

| | | | |
|---|---|---|---|
| 2004/0071297 | A1 | 4/2004 | Katou et al. |
| 2017/0280215 | A1 | 9/2017 | Lee et al. |
| 2018/0278882 | A1 | 9/2018 | Miyasaka |

FOREIGN PATENT DOCUMENTS

| | | | |
|---|---|---|---|
| JP | S6428100 | U | 2/1989 |
| JP | 4286510 | B2 | 7/2009 |
| JP | 2012165099 | A | 8/2012 |
| JP | 5680487 | B2 | 3/2015 |
| JP | 6318219 | B2 | 4/2018 |
| JP | 2018110369 | A | 7/2018 |
| WO | 2017094429 | A1 | 6/2017 |

OTHER PUBLICATIONS

English machine translation of JP 2012-165099A (Year: 2012).*

(Continued)

*Primary Examiner* — James K Mooney
(74) *Attorney, Agent, or Firm* — McDermott Will & Emery LLP

(57) ABSTRACT

An acoustic device that reproduces audio signals, the acoustic device including: a first acoustic reproducer that reproduces a signal corresponding to a treble range among the audio signals; a second acoustic reproducer that has a reproduction band from a cutoff frequency on a low frequency side to a cutoff frequency on a high frequency side, and reproduces a signal corresponding to a midrange lower than the treble range among the audio signals; and a harmonic overtone generator that generates a plurality of harmonic overtone signals for a fundamental tone signal corresponding to a specific frequency lower than the cutoff frequency on the low frequency side among the audio signals, wherein at least a part of the plurality of harmonic overtone signals is included in the reproduction band of the second acoustic reproducer.

8 Claims, 18 Drawing Sheets

(56) References Cited

OTHER PUBLICATIONS

Gavin, Brady. "What Are Woofers, Mid-Range Speakers, and Tweeters?" How-To Geek, Jul. 18, 2018, www.howtogeek.com/354985/what-are-woofers-mid-range-speakers-and-tweeters/ (Year: 2018).*

International Search Report (ISR) and Written Opinion of the International Searching Authorogy (ISA) dated Jan. 8, 2019 in International (PCT) Application No. PCT/JP2018/037088, with English translation.

First Office Action dated Nov. 3, 2021, issued in corresponding Chinese Patent Application No. 201880097866.5; with English translation.

* cited by examiner

| Load | Third filter (passband) | Second filter (passband) | Gain of third filter or second filter |
|---|---|---|---|
| 0 g | 150 Hz ~ 300 Hz | 300 Hz ~ 600 Hz | 6 dB |
| 10 g | 40 Hz ~ 80 Hz | 80 Hz ~ 300 Hz | 9 dB |
| 20 g | 35 Hz ~ 70 Hz | 70 Hz ~ 300 Hz | 6 dB |
| 30 g | 30 Hz ~ 60 Hz | 60 Hz ~ 300 Hz | 3 dB |
| 40 g | 25 Hz ~ 50 Hz | 50 Hz ~ 300 Hz | 0 dB |

FIG. 16A
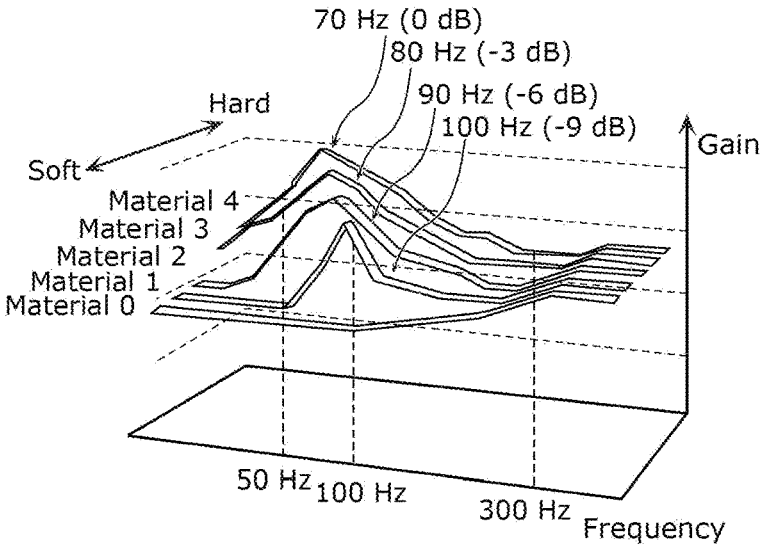
FIG. 16B
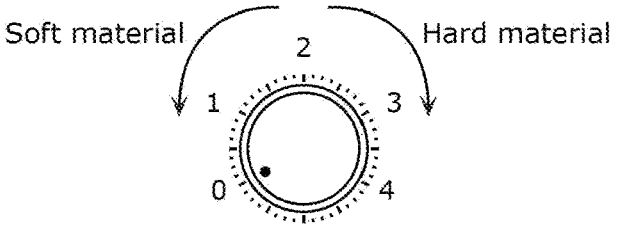
FIG. 16C
| Material | Third filter (passband) | Second filter (passband) | Gain of third filter or second filter |
|---|---|---|---|
| 0 | 150 Hz ~ 300 Hz | 300 Hz ~ 600 Hz | 6 dB |
| 1 | 40 Hz ~80 Hz | 80 Hz ~ 300 Hz | 9 dB |
| 2 | 35 Hz ~70 Hz | 70 Hz ~ 300 Hz | 6 dB |
| 3 | 30 Hz ~60 Hz | 60 Hz ~ 300 Hz | 3 dB |
| 4 | 25 Hz ~50 Hz | 50 Hz ~ 300 Hz | 0 dB |

ACOUSTIC DEVICE AND ACOUSTIC REPRODUCTION METHOD FOR PRODUCING HIGH QUALITY BASS SOUND

CROSS REFERENCE TO RELATED APPLICATION

This is a continuation application of PCT Patent Application No. PCT/JP2018/037088 filed on Oct. 3, 2018, designating the United States of America. The entire disclosure of the above-identified application, including the specification, drawings and claims is incorporated herein by reference in its entirety.

FIELD

The present disclosure relates to an acoustic device and an acoustic reproduction method using a first acoustic reproducer that reproduces a signal corresponding to a treble range among the audio signals and a second acoustic reproducer that reproduces a signal corresponding to a midrange lower than the treble range among the audio signals.

BACKGROUND

In recent years, due to emphasis on cost and housing design, it may not be possible to secure sufficient housing capacity to reproduce the bass component of the audio signal in an acoustic device such as a speaker. As a method of audibly expanding the reproduction band of a speaker that cannot reproduce the bass component, a technique using a missing fundamental phenomenon has been put into practical use. The missing fundamental phenomenon is an auditory phenomenon in which, for example, when the fundamental tone is 80 Hz, if the fundamental tone is not audibly output and only 160 Hz, 240 Hz, 320 Hz, 400 Hz, . . . , which are the harmonic overtones thereof, are audibly output simultaneously, the pitch of the fundamental tone which does not exist is perceived. By utilizing this phenomenon, for example, even a small speaker that cannot reproduce the fundamental tone can reproduce the fundamental tone audibly by adding the harmonic overtones thereof to the audio signal (Patent Literature (PTL) 1).

CITATION LIST

Patent Literature

PTL 1: Japanese Patent No. 4286510
PTL 2: Japanese Patent No. 5680487

SUMMARY

Technical Problem

However, in the reproduction method using the missing fundamental phenomenon, harmonic overtones may be strongly perceived. In this case, harmonic overtones that do not exist in the original audio signal may be annoying and cause discomfort to the user.

In addition, as another technology related to the combination of reproduction of mid-low range and miniaturization of a speaker, a technology using an actuator and a diaphragm has been proposed (PTL 2). In PTL 2, the miniaturization is realized by using a part of the housing of the speaker as a diaphragm, and the reproduction of mid-low range is realized by adding an inertial mass element to the actuator.

However, in the technology described in PTL 2, it is necessary to increase the size of the inertial mass element in order to realize bass reproduction. For this reason, the miniaturization of the speaker cannot be achieved.

The present disclosure has been made to solve such a problem, and an object of the present invention is to provide an acoustic device and an acoustic reproduction method capable of reproducing high-quality bass without using an acoustic reproducer dedicated to the bass range.

Solution to Problem

In order to achieve the above object, the acoustic device according to one embodiment of the present disclosure is an acoustic device that reproduces audio signals, the acoustic device including: a first acoustic reproducer that reproduces a signal corresponding to a treble range among the audio signals; a second acoustic reproducer that has a reproduction band from a cutoff frequency on a low frequency side to a cutoff frequency on a high frequency side, and reproduces a signal corresponding to a midrange lower than the treble range among the audio signals; and a harmonic overtone generator that generates a plurality of harmonic overtone signals for a fundamental tone signal corresponding to a specific frequency lower than the cutoff frequency on the low frequency side among the audio signals, wherein at least a part of the plurality of harmonic overtone signals is included in the reproduction band of the second acoustic reproducer.

In addition, in order to achieve the above object, the acoustic reproduction method according to one embodiment of the present disclosure is an acoustic reproduction method of reproducing audio signals using a first acoustic reproducer that reproduces a signal corresponding to a treble range among the audio signals, and a second acoustic reproducer that has a reproduction band from a cutoff frequency on a low frequency side to a cutoff frequency on a high frequency side, and reproduces a signal corresponding to a midrange lower than the treble range among the audio signals, the acoustic reproduction method comprising: generating a plurality of harmonic overtone signals for a fundamental tone signal corresponding to a frequency lower than the cutoff frequency on the low frequency side among the audio signals; and reproducing at least a part of the plurality of harmonic overtone signals by the second acoustic reproducer.

Advantageous Effects

It is an object of the present disclosure to provide an acoustic device and an acoustic reproduction method capable of reproducing high-quality bass without using an acoustic reproducer dedicated to the bass range.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 16A is a conceptual diagram showing the relationship between the hardness of the material used at the installation location and the frequency characteristics of vibration caused by the actuator.

FIG. 16B is a diagram showing an example of an operation means included in the setter according to Embodiment 2.

FIG. 16C is a diagram showing an example of a table included in the setter according to Embodiment 2.

DESCRIPTION OF EMBODIMENTS

Figure 1:
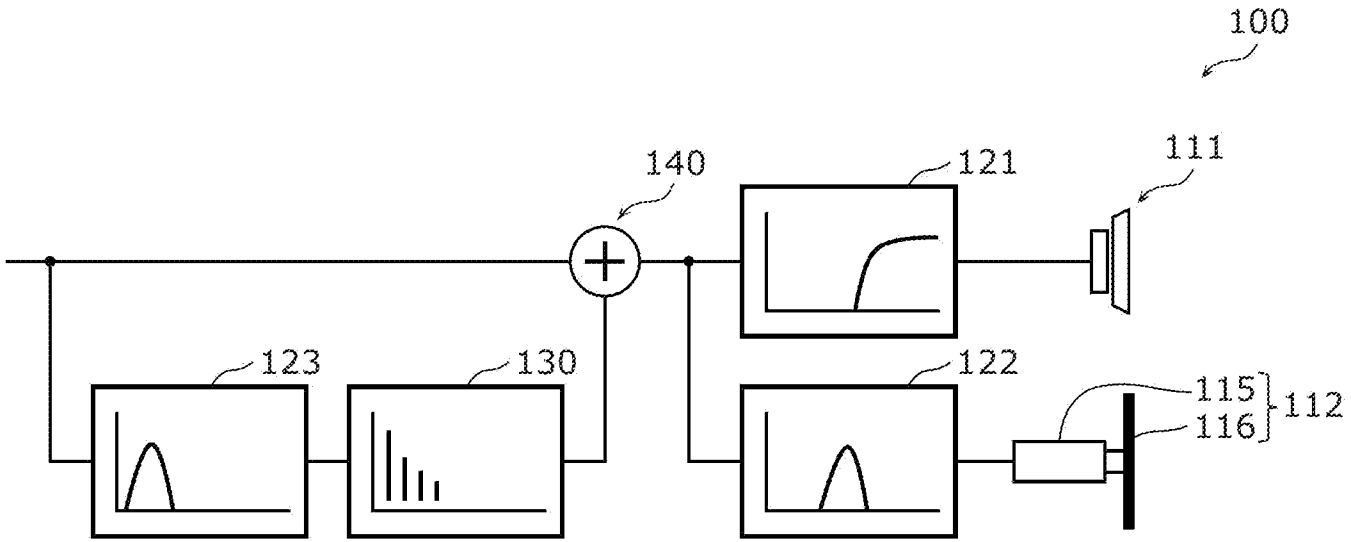
FIG. 1 is a block diagram showing a configuration of an acoustic device according to Embodiment 1.

Hereinafter, embodiments of the present disclosure will be described in detail with reference to the drawings. It should be noted that each of the embodiments described below will show a specific example of the present disclosure. Numerical values, shapes, materials, standards, components, arrangement positions and connection forms of components, steps, order of steps, and the like shown in the following embodiments are examples, and are not intended to limit the present disclosure. In addition, among the components in the following embodiments, the components not described in the independent claims indicating the highest level concept of the present disclosure will be described as arbitrary components. In addition, each figure is not necessarily a precise illustration. In each figure, substantially the same configuration may be designated by the same reference numerals, and duplicate description may be omitted or simplified.

Embodiment 1

The acoustic device and acoustic reproduction method according to Embodiment 1 will be described.

[1-1. Configuration]

First, the configuration of the acoustic device according to the present embodiment will be described with reference to the drawings. FIG. 1 is a block diagram showing a configuration of acoustic device 100 according to the present embodiment. Acoustic device 100 is a device that reproduces an audio signal, and includes first acoustic reproducer 111, second acoustic reproducer 112, and harmonic overtone generator 130, as shown in FIG. 1. In the present embodiment, acoustic device 100 further includes first filter 121, second filter 122, third filter 123, and adder 140.

It should be noted that the audio signal input to acoustic device 100 may be an analog signal or a digital signal. For example, when the audio signal is a digital signal, acoustic device 100 may include a D/A converter in which first acoustic reproducer 111 and second acoustic reproducer 112 convert the digital signal into an analog signal, and an amplifier that amplifies the analog signal.

First acoustic reproducer 111 is an acoustic reproducer that reproduces a signal corresponding to a treble range among the audio signals input to acoustic device 100. In the present embodiment, the treble range means, for example, a frequency band of 300 Hz or higher. As the first acoustic reproducer, a speaker capable of reproducing a treble range with flat characteristics, such as a so-called full-band speaker, a tweeter, or the like can be used.

Second acoustic reproducer 112 is an acoustic reproducer that reproduces a signal corresponding to a midrange lower than the treble range among the audio signals input to acoustic device 100. In the present embodiment, the midrange means, for example, a frequency band of 120 Hz or more and less than 300 Hz. Second acoustic reproducer 112 has a reproduction band from a cutoff frequency on the low frequency side to a cutoff frequency on the high frequency side. The cutoff frequency used here is a frequency at which the gain of second acoustic reproducer 112 is reduced by 6 dB from the maximum value.

As second acoustic reproducer 112, for example, an acoustic reproducer that combines actuator 115 that vibrates in synchronization with an audio signal and diaphragm 116 driven by the actuator can be used. Actuator 115 is a device that vibrates diaphragm 116, and for example, a magnetostrictive actuator or the like can be used. In addition, as diaphragm 116, for example, a structure holding first acoustic reproducer 111 can be used. Specifically, the bottom plate or the like of the housing of acoustic device 100 can be used as diaphragm 116. With this, second acoustic reproducer 112 can be formed without adding a separate member as diaphragm 116 to acoustic device 100. Therefore, it is possible to suppress the increase in size of acoustic device 100 due to the provision of second acoustic reproducer 112.

Figure 2:
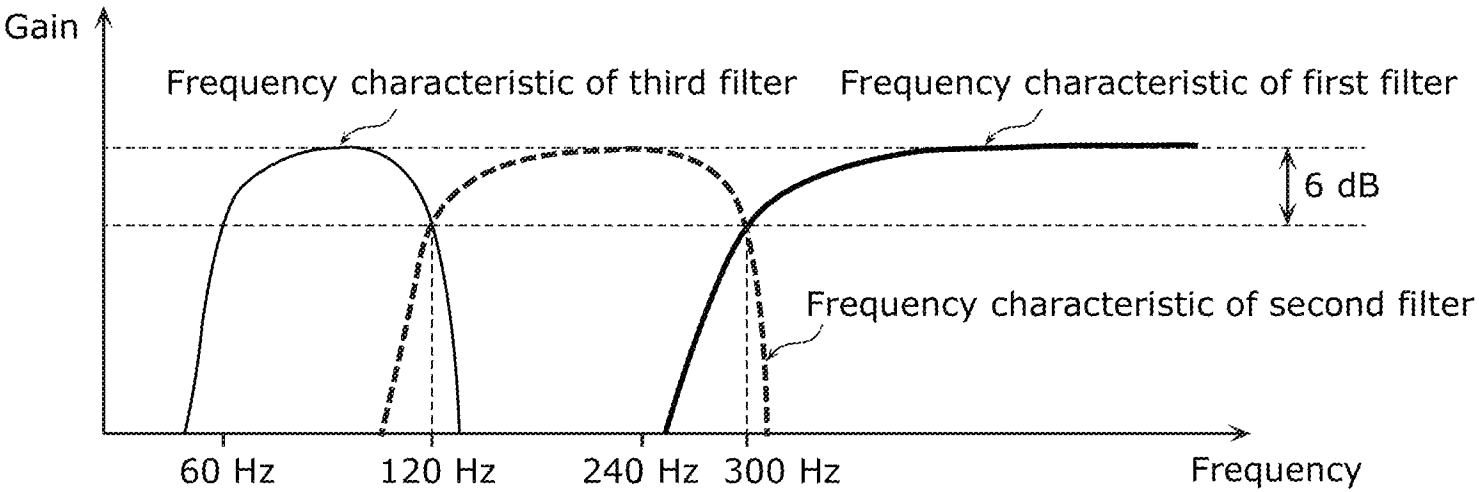
FIG. 2 is a graph showing the frequency characteristics of the first filter, the second filter, and the third filter according to Embodiment 1.

First filter 121 is a filter that selectively passes a signal corresponding to a treble range among audio signals and supplies the signal to first acoustic reproducer 111. First filter 121 passes the frequency component reproduced by first acoustic reproducer 111. In the present embodiment, first filter 121 is a high-pass filter having a cutoff frequency higher than the frequency twice as high as the specific frequency described later. First filter 121 selectively transmits a signal corresponding to a frequency of, for example, 300 Hz or higher. Here, the frequency characteristic of first filter 121 will be described with reference to FIG. 2. FIG. 2 is a graph showing the frequency characteristics of first filter 121, second filter 122, and third filter 123 according to the present embodiment. The horizontal axis of FIG. 2 indicates the frequency, and the vertical axis indicates the gain. As shown by the thick solid line graph of FIG. 2, first filter 121 is a high-pass filter having a cutoff frequency of about 300 Hz. Here, the cutoff frequency is a frequency at which the gain is reduced by 6 dB from the maximum value.

Second filter 122 is a filter that selectively passes a signal corresponding to the midrange among audio signals and supplies the signal to second acoustic reproducer 112. Second filter 122 passes the frequency component reproduced by second acoustic reproducer 112. In the present embodiment, second filter 122 is a bandpass filter that passes a frequency twice as high as a specific frequency described later. Second filter 122 selectively passes a signal corresponding to frequencies from, for example, 120 Hz to 300 Hz. That is, as shown by the broken line graph in FIG. 2, second filter 122 is a bandpass filter having a cutoff frequency on the low frequency side of about 120 Hz and a cutoff frequency on the high frequency side of about 300 Hz.

Third filter 123 is a filter that selectively passes a fundamental tone signal corresponding to a specific frequency lower than the cutoff frequency on the low frequency side of second acoustic reproducer 112 and supplies the fundamental tone signal to the harmonic overtone generator. In the present embodiment, third filter 123 is, for example, a bandpass filter that selectively passes a fundamental tone signal corresponding to a specific frequency of 60 Hz or more and less than 120 Hz. That is, as shown by the thin solid line in FIG. 2, third filter 123 is a bandpass filter having a cutoff frequency on the low frequency side of 60 Hz and a cutoff frequency on the high frequency side of 120 Hz. It should be noted that in the present embodiment, the specific frequency is 60 Hz or more and less than 120 Hz, but the range of the specific frequency is not limited thereto. For example, the specific frequency may be 50 Hz or more and less than 100 Hz, or the like.

As described above, first filter 121 is a high-pass filter having a cutoff frequency of 300 Hz, second filter 122 is a bandpass filter having a passable frequency of 120 Hz or more and less than 300 Hz, and third filter 123 is a bandpass filter having a passable frequency of 60 Hz or more and less than 120 Hz. That is, as shown in FIG. 2, the curves showing the frequency characteristics of the respective filters intersect at the frequency at which the gain is reduced by 6 dB from the maximum value. It should be noted that of course, the frequency characteristics of the respective filters do not have to exactly match the characteristics shown in FIG. 2, and may include an error according to the quality required for acoustic device 100.

Figure 3:
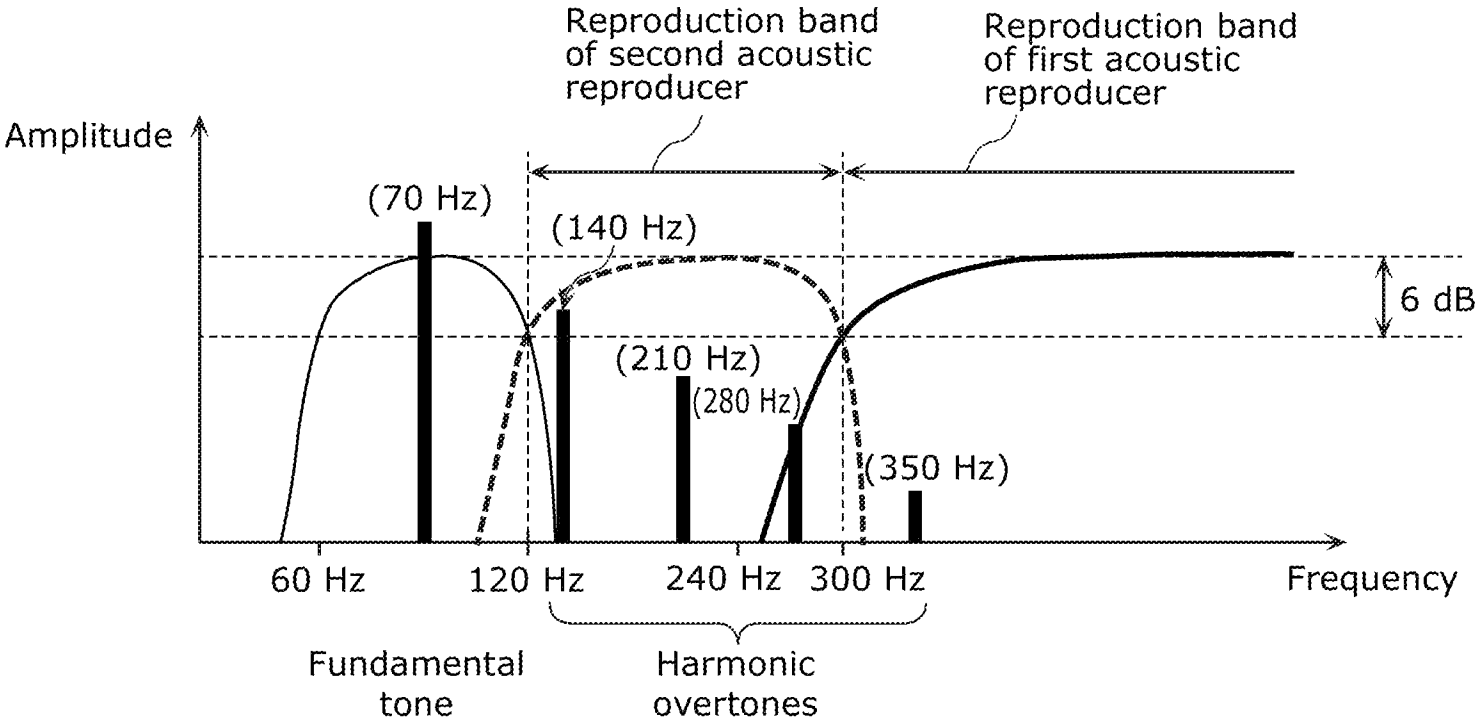
FIG. 3 is a diagram showing the relationship between the harmonic overtone signals generated by the harmonic overtone generator according to Embodiment 1 and the reproduction bands of the first acoustic reproducer and the second acoustic reproducer.

Harmonic overtone generator 130 is a signal generator that generates a plurality of harmonic overtone signals with respect to the fundamental tone signal among the audio signals. Harmonic overtone generator 130 will be described with reference to FIG. 3. FIG. 3 is a diagram showing the relationship between the harmonic overtone signals generated by harmonic overtone generator 130 according to the present embodiment and the reproduction bands of first acoustic reproducer 111 and second acoustic reproducer 112. In FIG. 3, a case where the specific frequency corresponding to the fundamental tone signal is 70 Hz is shown as an example. It should be noted that the reproduction band of first acoustic reproducer 111 means a frequency band equal to or higher than the cutoff frequency on the low frequency side of first acoustic reproducer 111.

As shown in FIG. 3, when the specific frequency corresponding to the fundamental tone signal is 70 Hz, harmonic overtone generator 130 generates a plurality of harmonic overtone signals corresponding to frequencies such as 140 Hz, 210 Hz, 280 Hz, and 350 Hz. At least a part of the plurality of harmonic overtone signals is included in the reproduction band of the second acoustic reproducer.

Adder 140 is a calculator that adds the audio signal input to acoustic device 100 and the output signal of harmonic overtone generator 130, and supplies the added signal to first filter 121 and second filter 122.

[1-2. Operation]

Figure 4:
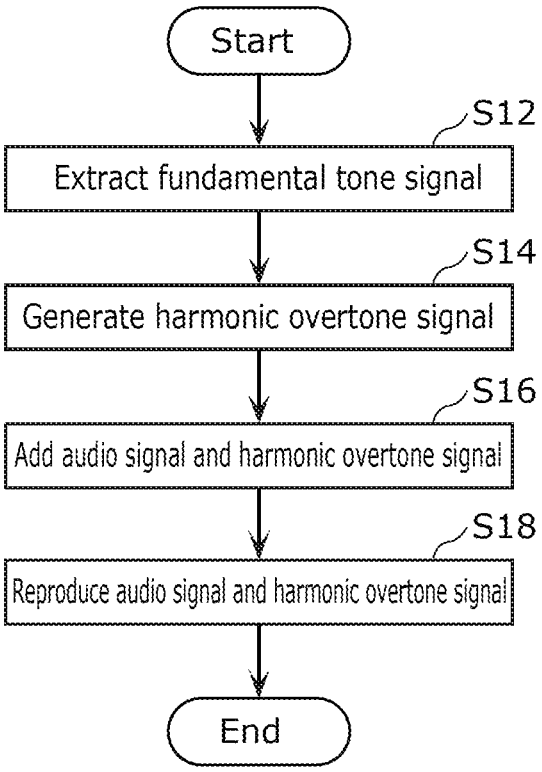
FIG. 4 is a flowchart showing an acoustic reproduction method according to Embodiment 1.

Next, the operation of acoustic device 100 configured as described above and the acoustic reproduction method used in acoustic device 100 will be described with reference to FIG. 4 and the like. FIG. 4 is a flowchart showing an acoustic reproduction method according to the present embodiment.

The acoustic reproduction method according to the present embodiment is a method of reproducing an audio signal by using first acoustic reproducer 111 that reproduces a signal corresponding to a treble range among audio signals, and second acoustic reproducer 112 that has a reproduction band from a cutoff frequency on the low frequency side to a cutoff frequency on the high frequency side and reproduces a signal corresponding to a midrange lower than a treble range among the audio signals.

As shown in FIG. 4, in the acoustic reproduction method according to the present embodiment, first, a fundamental tone signal corresponding to a frequency lower than the cutoff frequency on the low frequency side is extracted from the audio signals input to acoustic device 100 (S12). Specifically, the fundamental tone signal corresponding to the specific frequency is passed through third filter 123. In the present embodiment, the outline of the frequency characteristic of third filter 123 is shown by a thin solid line in FIG. 2. As shown in FIG. 2, third filter 123 passes a fundamental tone signal corresponding to a frequency of about 60 Hz or more and less than 120 Hz.

Subsequently, a plurality of harmonic overtone signals with respect to the extracted fundamental tone signal are generated (S14). Specifically, a plurality of harmonic overtone signals with respect to the fundamental tone signal are generated by harmonic overtone generator 130. In the example shown in FIG. 3 described above, harmonic overtone signals when the fundamental tone signal is 70 Hz are shown. As shown in FIG. 3, the fundamental tone signal itself cannot be substantially reproduced by either first acoustic reproducer 111 or second acoustic reproducer 112, but the lower-order ones of the harmonic overtone signals can be reproduced by second acoustic reproducer 112, and higher-order ones thereof can be reproduced by first acoustic reproducer 111. For this reason, it is possible to perceive the fundamental tone signal by the missing fundamental phenomenon. Here, the method of generating the harmonic overtone signals is not particularly limited. In order to generate harmonic overtone signals, for example, the method disclosed in PTL 1 may be used.

Subsequently, the audio signal and a plurality of harmonic overtone signals, which are output signals of harmonic overtone generator 130, are added by adder 140 (S16). Specifically, the signal generated by adder 140 is supplied to first filter 121 and second filter 122. Here, the outline of the frequency characteristic of first filter 121 is shown by the thick solid line in FIG. 2. First filter 121 passes a signal corresponding to a frequency of about 300 Hz or higher, and this passing frequency band corresponds to the reproduction band of first acoustic reproducer 111. In addition, the outline of the frequency characteristic of second filter 122 is shown by the dotted line in FIG. 2. Second filter 122 passes a signal corresponding to a frequency of about 120 Hz or more and less than 300 Hz, and this passing frequency band corresponds to the reproduction band of second acoustic reproducer 112.

Subsequently, the audio signal and the plurality of harmonic overtone signals are reproduced by first acoustic reproducer 111 and second acoustic reproducer 112 (S18). Here, at least a part of the plurality of harmonic overtone signals is reproduced by second acoustic reproducer 112. Specifically, among the audio signal and the plurality of harmonic overtone signals, the output signal of first filter 121 is reproduced (that is, audibly output) by first acoustic reproducer 111. Among the audio signal and the plurality of overtone signals, the output signal of second filter 122 is reproduced (that is, audibly output) by second acoustic reproducer 112.

As shown in FIG. 3, the fundamental tone signal passing through third filter 123 cannot be reproduced by either first acoustic reproducer 111 or second acoustic reproducer 112, but the lower-order ones among the plurality of harmonic overtone signals can be reproduced by second acoustic reproducer 112, and higher-order ones can be reproduced by first acoustic reproducer 111. For this reason, it is possible to perceive the sound corresponding to the fundamental tone signal due to the missing fundamental phenomenon.

[1-3. Effects]

Figure 5:
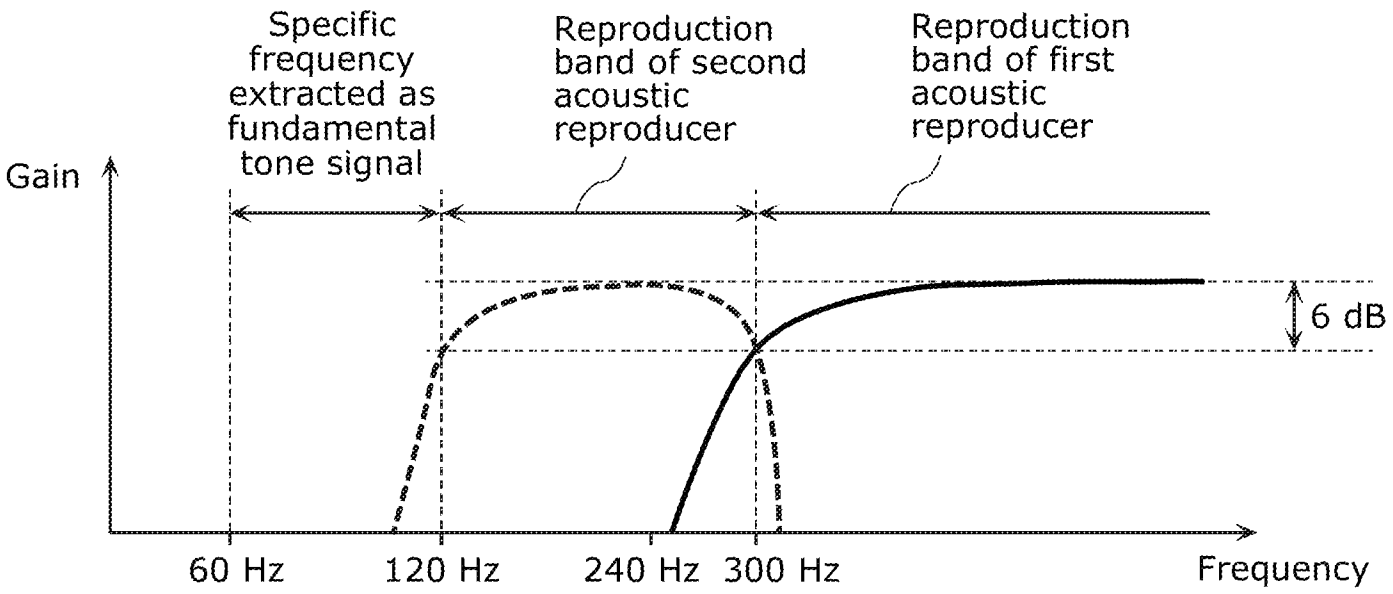
FIG. 5 is a diagram showing a reproduction band of the first acoustic reproducer, a reproduction band of the second acoustic reproducer, and a band having a specific frequency corresponding to a fundamental tone signal, according to Embodiment 1.
Figure 6:
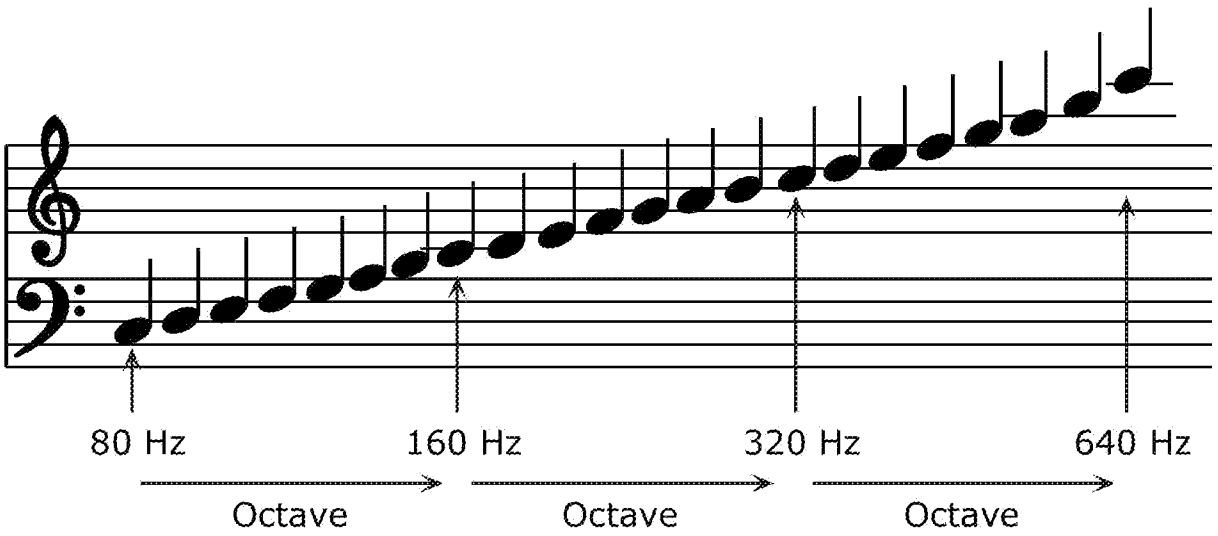
FIG. 6 is a diagram in which an audio signal is represented by musical notes.
Figure 7:
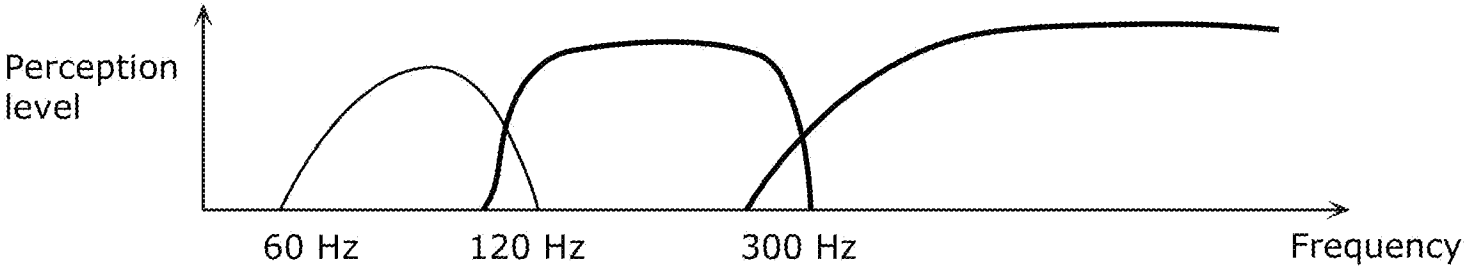
FIG. 7 is a graph showing the relationship between the frequency of the audio signal reproduced by the acoustic device according to Embodiment 1 and the perception level.
Figure 8:
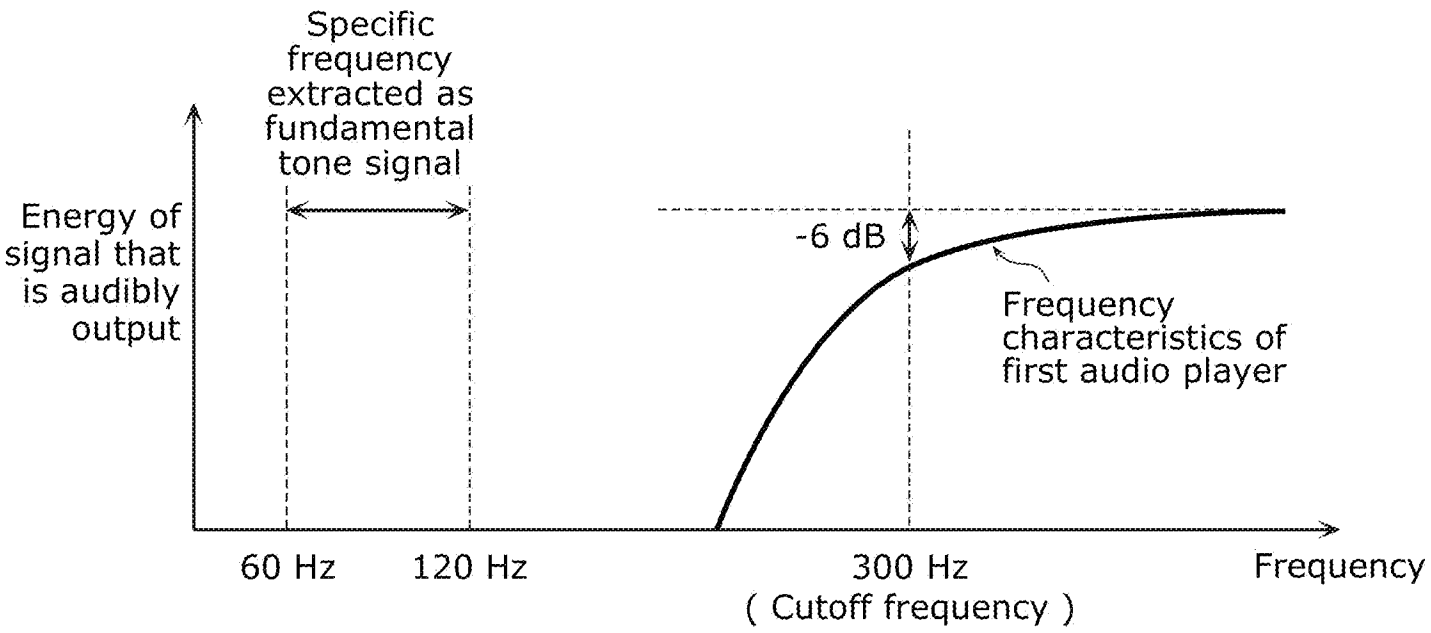
FIG. 8 is a graph showing the relationship between the frequency and the energy of the audibly-output signal in the acoustic device of the comparative example.
Figure 9:
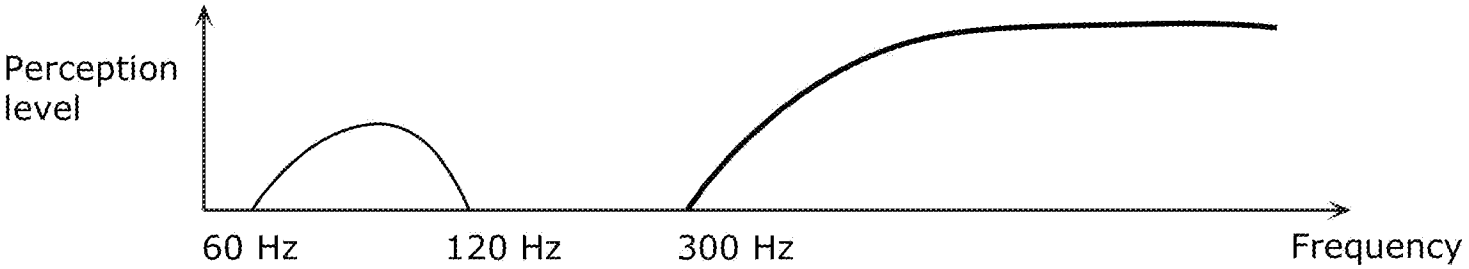
FIG. 9 is a graph showing the relationship between the frequency of the audio signal reproduced by the acoustic device of the comparative example and the perception level.

Next, the effects of acoustic device 100 and the acoustic reproduction method according to the present embodiment will be described with reference to FIG. 5 to FIG. 8 while comparing with a comparative example. FIG. 5 is a diagram showing a reproduction band of first acoustic reproduction device 111, a reproduction band of second acoustic reproduction device 112, and a band of a specific frequency corresponding to the fundamental tone signal, according to the present embodiment. FIG. 6 is a diagram in which audio signals are represented by musical notes. It is assumed that the lowest frequency audio signal in FIG. 6 is 80 Hz. Assuming that this 80 Hz audio signal is regarded as the sound of Do in the scale, FIG. 6 shows the scale starting from that sound up to 640 Hz, which is three octaves higher. FIG. 7 is a graph showing the relationship between the frequency of the audio signal reproduced by acoustic device 100 according to the present embodiment and the perception level. FIG. 8 is a graph showing the relationship between the frequency and the energy of the audibly-output signal in the acoustic device of the comparative example. FIG. 9 is a graph showing the relationship between the frequency of the audio signal reproduced by the acoustic device of the comparative example and the perception level. The acoustic device of the comparative example includes the same configuration as acoustic device 100 according to the present embodiment except that second acoustic reproducer 112 is not included.

Here, among the audio signals shown in FIG. 6, the frequency of the sound of the lowest frequency Do is 80 Hz, so that it passes through third filter 123 and the harmonic overtone signals thereof are generated by harmonic overtone generator 130. Since the frequencies of the generated plurality of harmonic overtone signals are 160 Hz, 240 Hz, 320 Hz, 400 Hz, . . . , the low-order harmonic overtone signals can be reproduced by second acoustic reproducer 112, and the high-order harmonic overtone signals are reproduced by acoustic reproducer 111, so that the 80 Hz Do sound itself cannot be reproduced, but it can be perceived by the missing fundamental phenomenon. The sounds up to around Re, Mi, Fa, and So following the 80 Hz Do sound can also be perceived by the missing fundamental phenomenon in the same manner. The leftmost curve in FIG. 7 represents the level perceived by such a missing fundamental phenomenon.

Although the harmonic overtone signals for the sound signal corresponding to from the sound of La following the sound signal perceived by using the missing fundamental phenomenon described above to the sound about one octave higher are not generated, the sound signal itself can be reproduced by second acoustic reproducer 112. The horizontal center curve in FIG. 7 represents the perception level for the audio signal reproduced by second acoustic reproducer 112.

Sound higher than the reproduction band of second acoustic reproducer 112 can be reproduced by first acoustic reproducer 111. Since first acoustic reproducer 111 is a speaker dedicated to the treble range, it can reproduce an audio signal in the treble range with flat characteristics. The rightmost curve in FIG. 7 represents the perception level for the audio signal reproduced by first acoustic reproducer 111.

In this way, all the frequency components shown in FIG. 6 are perceptible or reproducible in the configuration of Embodiment 1.

On the other hand, in the acoustic device of the comparative example, the sounds substantially up to the Re, Mi, Fa, and So sounds following the 80 Hz Do sound can be perceived by using the missing fundamental phenomenon as in acoustic device 100 according to the present embodiment. However, since the acoustic device of the comparative example does not include second acoustic reproducer 112 as shown in FIG. 8, the harmonic overtone signals are reproduced only by first acoustic reproducer 111 as shown in FIG. 9. For this reason, in the acoustic device of the comparative example, the perception level of the fundamental tone signal is lower than that in the case of using acoustic device 100 according to the present embodiment. As a countermeasure against this, it is also conceivable to raise the perception level of the fundamental tone signal by raising the level of the harmonic overtone signal. However, in the treble range, the human auditory sensitivity is relatively high, so that the perception level of the sound of the harmonic overtone signal itself becomes high, and the harmonic overtone signal feels annoying.

On the other hand, in the present embodiment, second acoustic reproducer 112 that reproduces the midrange is included, and at least a part of the plurality of harmonic overtone signals is included in the reproduction band of second acoustic reproducer 112. With this, the missing fundamental phenomenon can be realized by the harmonic overtone signals in the midrange where the human auditory sensitivity is relatively low. Therefore, according to acoustic device 100 according to the present embodiment, it is possible to perceive a bass sound close to the sound when the fundamental tone signal itself is reproduced by the speaker for the bass range. Therefore, according to acoustic device 100 according to the present embodiment, it is possible to perceive a richer bass sound than the acoustic device of the comparative example, and it is possible to suppress the perception of the harmonic overtone signal itself. In this way, according to acoustic device 100 and the acoustic reproduction method according to the present embodiment, high-quality bass can be reproduced without using an acoustic reproducer dedicated to the bass range.

In addition, in the present embodiment, the second filter is a bandpass filter that passes a frequency twice as high as the specific frequency, and the frequency twice as high as the specific frequency is included in the reproduction band of second acoustic reproducer 112. With this, the lowest-order harmonic overtone signal, that is, the harmonic tone signal having the lowest human auditory sensitivity can be reproduced by second acoustic reproducer 112, so that the perception of the harmonic overtone signal itself can be suppressed.

Furthermore, since the first filter is a high-pass filter having a cutoff frequency higher than the frequency twice as high as the specific frequency in the present embodiment, the low-order harmonic overtone signals are not reproduced by first acoustic reproducer 111. Therefore, since the low-order harmonic overtone signals are not reproduced by the two acoustic reproducers, the harmonic overtone signals can be reproduced without unevenness of the timbre.

In addition, acoustic device 100 according to the present embodiment can reproduce the harmonic overtone signals by second acoustic reproducer 112 including actuator 115 and diaphragm 116. For this reason, acoustic device 100 can be made smaller than when a speaker dedicated to the bass range such as a woofer is used. Moreover, since the audio signal in the treble range can be reproduced by the speaker dedicated to the treble range, it is possible to realize an acoustic device capable of obtaining flat frequency characteristics in the treble range as compared with the case of using a small speaker for both the midrange and the treble range.

[1-4. Variation 1]

Figure 10:
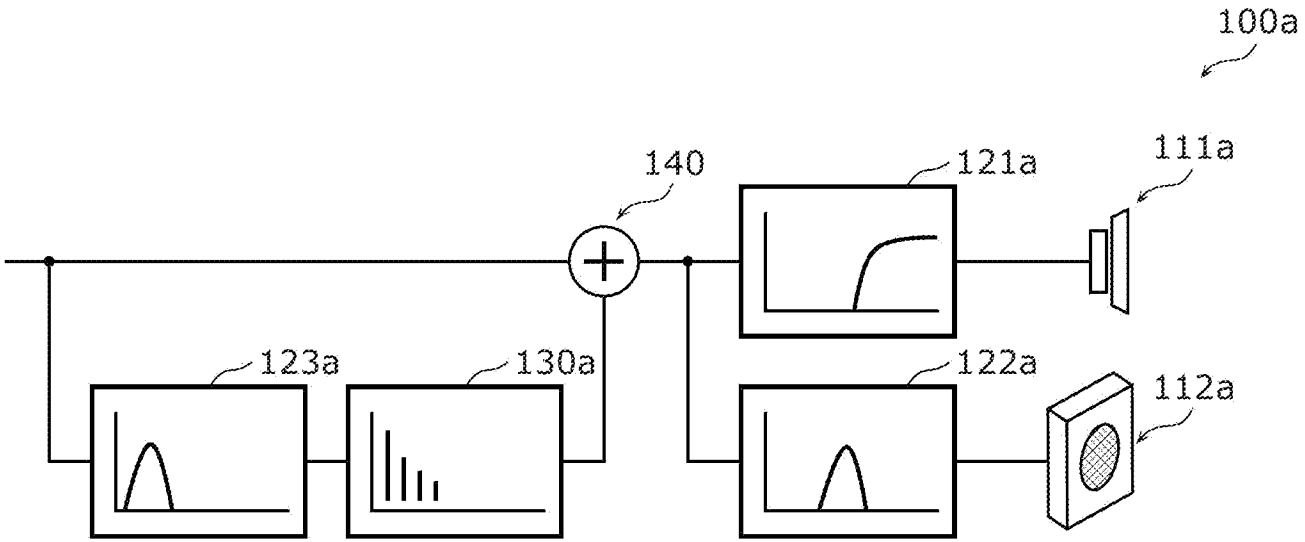
FIG. 10 is a block diagram showing a configuration of an acoustic device according to Variation 1 of Embodiment 1.
Figure 11:
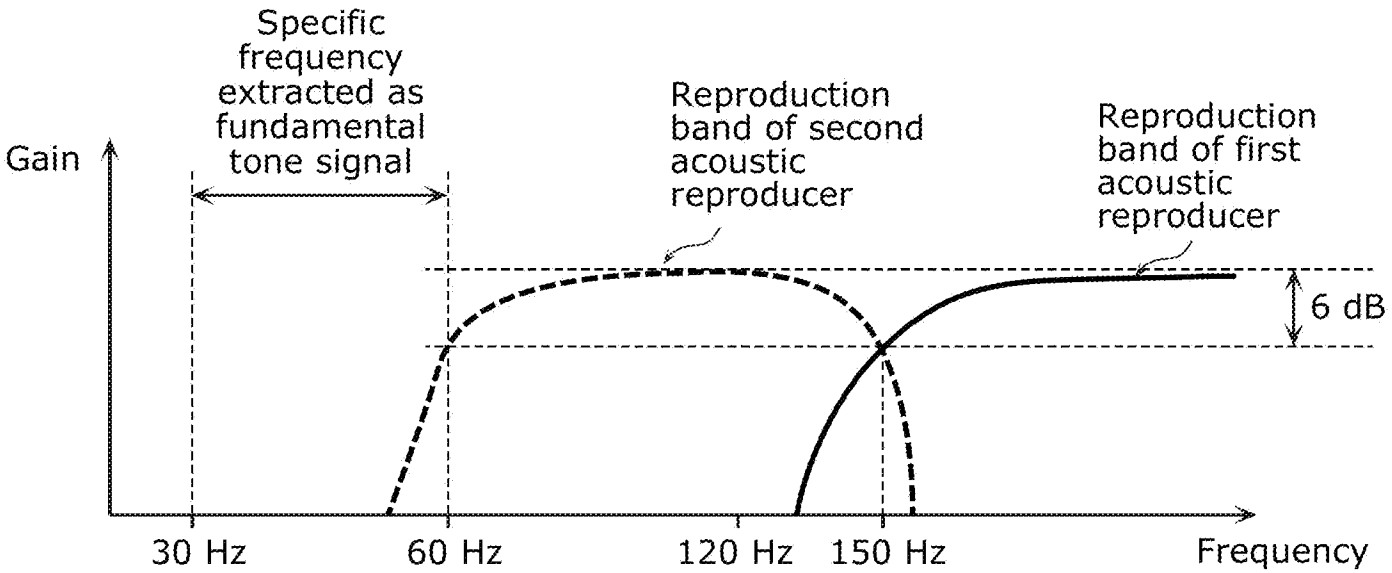
FIG. 11 is a graph showing the reproduction bands of the first acoustic reproducer and the second acoustic reproducer according to Variation 1 of Embodiment 1.

In the present embodiment, as second acoustic reproducer 112, actuator 115 that vibrates in synchronization with an audio signal and diaphragm 116 driven by actuator 115 are used, but the configuration of the second acoustic reproducer is not limited thereto. For example, as the second acoustic reproducer, a woofer that reproduces the midrange may be used. A variation in which the woofer is used as the second acoustic reproducer will be described with reference to FIG. 10 and FIG. 11. FIG. 10 is a block diagram showing the configuration of acoustic device 100*a* according to Variation 1 of the present embodiment. FIG. 11 is a graph showing the reproduction bands of first acoustic reproducer 111*a* and second acoustic reproducer 112*a* according to the present variation. As shown in FIG. 10, acoustic device 100*a* according to the present variation includes first acoustic reproducer 111*a*, second acoustic reproducer 112*a*, harmonic overtone generator 130, first filter 121*a*, second filter 122*a*, third filter 123*a*, and adder 140, similarly to acoustic device 100 according to Embodiment 1. In the present variation, second acoustic reproducer 112*a* is a woofer. Here, the woofer is defined as a speaker that reproduces an audio signal in any range from the low range to the midrange and has a dedicated diaphragm. For example, the woofer does not include an acoustic reproducer that uses a housing or the like as diaphragm 116.

Since acoustic device 100*a* according to the present variation includes second acoustic reproducer 112*a* made of a woofer, the size is larger than that of acoustic device 100 according to Embodiment 1. However, in recent years, some woofers have been miniaturized, have a diameter of about 6 cm, and have a reproduction band of about 60 Hz or more and about 150 Hz or less. Such a relatively small woofer is used as second acoustic reproducer 112*a* according to the present variation (see FIG. 10). According to the reproduction band of the woofer, as shown in FIG. 10 and FIG. 11, a speaker having a reproduction band of 150 Hz or more is used as first acoustic reproducer 111*a*. In addition, a high-pass filter having a cutoff frequency of about 150 Hz is used as first filter 121*a*, and a band pass filter having respective cutoff frequencies on the low frequency side and the high frequency side are about 60 Hz and about 150 Hz is used as second filter 122*a*. In addition, a low-pass filter having a cutoff frequency of about 60 Hz is used as third filter 123*a*.

Harmonic overtone generator 130*a* is a signal generator that generates overtone signals with respect to a fundamental tone signal corresponding to a specific frequency of 30 Hz or more and less than 60 Hz.

By providing the above configuration, acoustic device 100*a* according to the present variation ends up to be larger than acoustic device 100 according to Embodiment 1 because a woofer is used as second acoustic reproducer 112*a*, although it is small. However, according to acoustic device 100*a* according to the present variation, a signal corresponding to a deep bass range (frequency band of 30 Hz or more and less than 60 Hz) that cannot be reproduced by a small woofer can be perceived by using the missing fundamental phenomenon.

[1-5. Variation 2]

Figure 12:
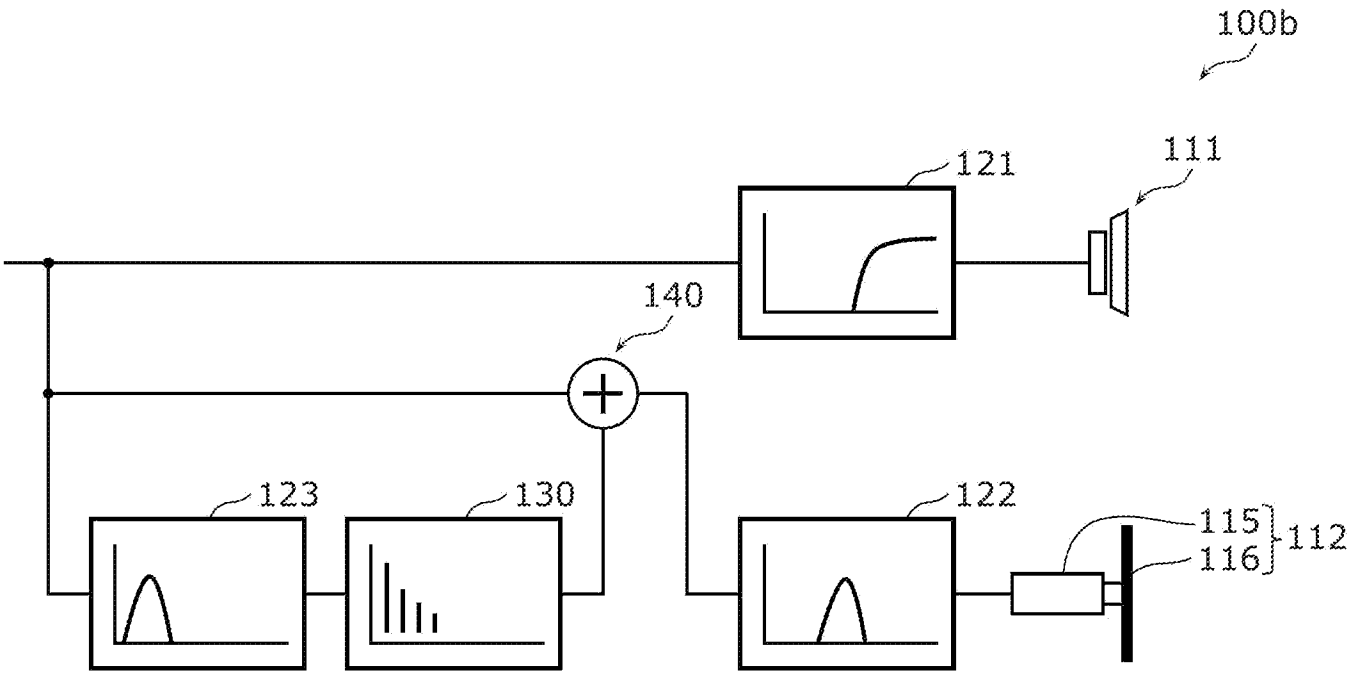
FIG. 12 is a block diagram showing a configuration of an acoustic device according to Variation 2 of Embodiment 1.

In the present embodiment, adder 140 adds the harmonic overtone signal from harmonic overtone generator 130 and the audio signal, and supplies the output signal to first filter 121 and second filter 122. That is, although the harmonic overtone signal is supplied to both first acoustic reproducer 111 and second acoustic reproducer 112, it may be supplied only to second acoustic reproducer 112. Hereinafter, a variation including such a configuration will be described with reference to FIG. 12. FIG. 12 is a block diagram showing the configuration of acoustic device 100*b* according to Variation 2 of the present embodiment. As shown in FIG. 12, the output signal of adder 140 may be supplied only to second filter 122, and only the audio signal may be supplied to first filter 121. That is, the plurality of harmonic overtone signals may not be supplied to first acoustic reproducer 111. Since the influence of the missing fundamental phenomenon on the perception level of the fundamental tone signal is dominated by the low-order harmonic overtone signals, there is no significant influence on the perception level of the fundamental tone signal even if the high-order harmonic overtone signals are not reproduced by first acoustic reproducer 111. Rather, since all the overtone signals can be reproduced by second acoustic reproducer 112, the harmonic overtone signals can be reproduced without unevenness of the timbre. Therefore, it is possible to reproduce rich bass with even higher sound quality. In addition, since the harmonic overtone signal in the treble range, where the human auditory sensitivity is relatively high, is not reproduced, it is possible to suppress the perception of the harmonic overtone signal itself.

Embodiment 2

The acoustic device and acoustic reproduction method according to Embodiment 2 will be described. The acoustic device and the acoustic reproduction method according to the present embodiment are different from acoustic device 100 and the acoustic reproduction method according to Embodiment 1 in that a second filter and a third filter are mainly set according to the characteristics of second acoustic reproducer 112. Hereinafter, the acoustic device according to the present embodiment will be described with reference to FIG. 13 to FIG. 17.

Figure 13:
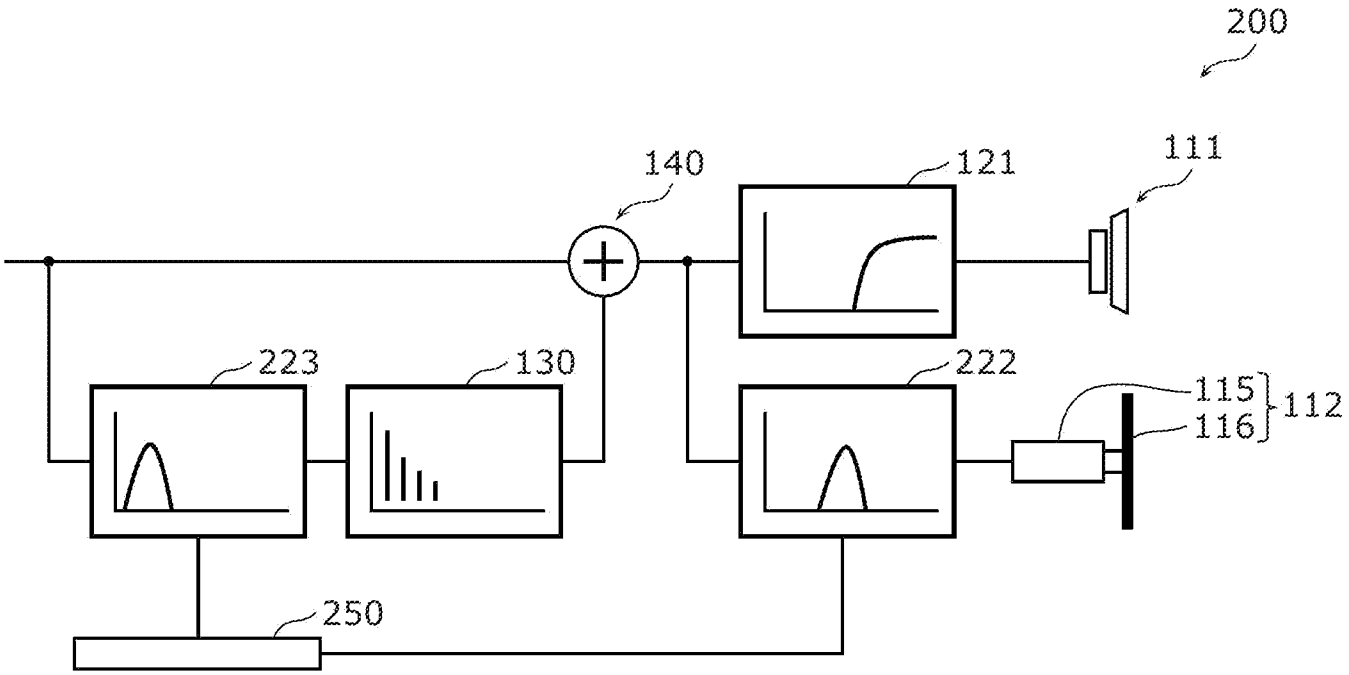
FIG. 13 is a block diagram showing a configuration of an acoustic device according to Embodiment 2.

FIG. 13 is a block diagram showing the configuration of acoustic device 200 according to the present embodiment. As shown in FIG. 13, acoustic device 200 according to the present embodiment includes first acoustic reproducer 111, second acoustic reproducer 112, harmonic overtone generator 130, first filter 121, second filter 222, and third filter 223, similarly to acoustic device 100 according to Embodiment 1. Acoustic device 200 according to the present embodiment further includes setter 250.

Figure 14:
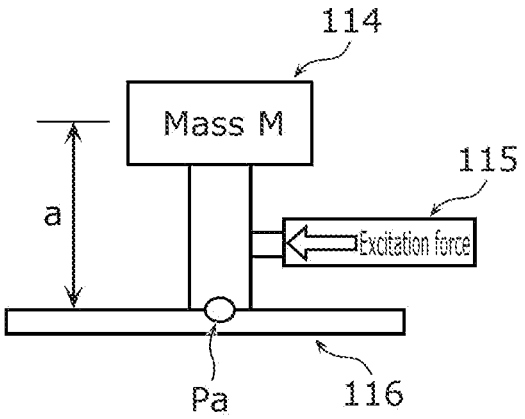
FIG. 14 is a structural diagram showing the relationship among the actuator, the diaphragm, and the load body applied to the whole thereof, according to Embodiment 2.

Setter 250 is a device that sets the frequency characteristics of second filter 222 and third filter 223. Setter 250 sets the frequency characteristics of second filter 222 and third filter 223 according to mass M of the additional load applied to the structure including diaphragm 116. More specifically, mass M of the additional load applied to the structure such as the housing is measured in advance or predicted, and the frequency characteristics of second filter 222 and third filter 223 are set according to that mass M. In the present embodiment, it is possible to cope with the fluctuation of the frequency component reproduced by second acoustic reproducer 112 according to mass M of the additional load applied to the structure including actuator 115 and diaphragm 116 by setter 250 appropriately setting the frequency characteristic of each filter. FIG. 14 is a structural diagram showing the relationship among actuator 115, diaphragm 116, and load body 114 applied to the whole thereof, according to the present embodiment. Assuming that the height of the center of gravity of the load body having mass M shown in FIG. 14 is a, the moment of inertia centered on point of action Pa is represented by $M \times a^2$. As mass M increases, this moment of inertia increases, and the resonance frequency of the mechanical resonance system decreases (see PTL 2). That is, the frequency band in which second acoustic reproducer 112 can reproduce fluctuates according to mass M of load body 114. Here, since mass M of load body 114 fluctuates due to factors such as the material and size of the housing of acoustic device 200, the frequency characteristics reproduced by the housing of the acoustic device are different even with the acoustic device using same actuator 115. Then, in FIG. 13, setter 250 is provided, and mass M of the additional load applied to the housing including actuator 115 and diaphragm 116 is measured in advance or predicted, so that the frequency characteristics of second filter 222 and third filter 223 can be set according to the mass. By doing so, even if mass M of the additional load fluctuates, actuator 115 and diaphragm 116 can reproduce high-quality and rich bass without changing the configuration of the device. Hereinafter, the setting of the frequency characteristics by setter 250 will be specifically described with reference to FIG. 15A and FIG. 15B.

Figures 15A, 15B:
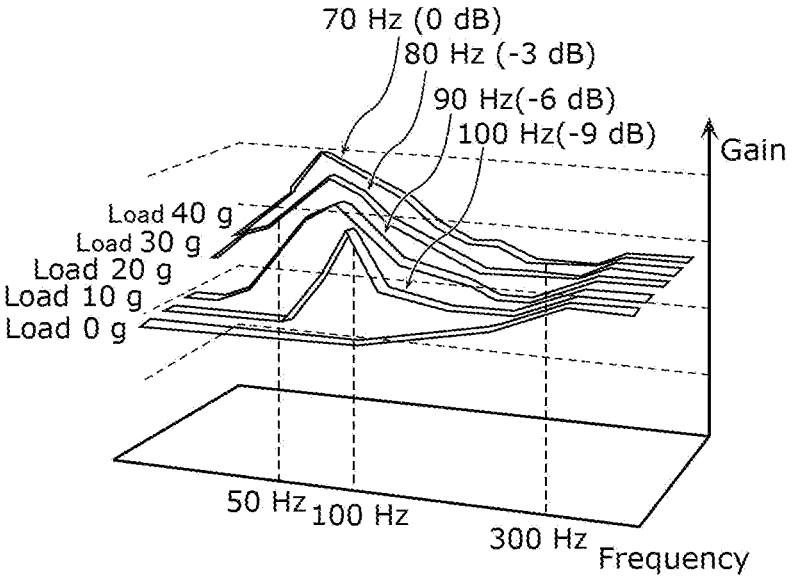
FIG. 15A is a conceptual diagram showing the relationship between the loads applied to the actuator and the frequency characteristics of vibration caused by the actuator, according to Embodiment 2.
FIG. 15B is a diagram showing an example of setting the frequency characteristic of the filter with respect to the loads according to Embodiment 2.

FIG. 15A is a conceptual diagram showing the relationship between the load applied to actuator 115 according to the present embodiment and the frequency characteristics of the vibration caused by actuator 115. FIG. 15B is a diagram showing an example of setting the frequency characteristics of the filters with respect to the load according to the present embodiment. FIG. 15B shows examples of setting the pass band and the gain of second filter 222 as well as examples of setting the pass band and the gain of third filter 223, which are set by setter 250.

As shown in FIG. 15A, when the load is 10 g, the signal in the frequency band near 100 Hz (frequency band of about 80 Hz or more and 300 Hz or less) is amplified by second acoustic reproducer 112. For this reason, in order to generate a harmonic overtone signal in that frequency band, third filter 223 extracts a signal in a frequency band near 50 Hz (a frequency band of about 40 Hz or more and 80 Hz or less) and sends the signal to harmonic overtone generator 130. Second filter 222 takes out a signal in a frequency band near 100 Hz (about 80 Hz or more and 300 Hz or less) and sends the signal to second acoustic reproducer 112. Here, when the load is 10 g, the amplification of the bass component is small, so that third filter 223 or second filter 222 may amplify the signal with a predetermined gain (amplification rate). In FIG. 15B, 9 dB amplification is shown. In the same way, the filter characteristics according to the load are determined as shown in FIG. 15B.

In the above example, setter 250 sets the filter characteristics according to the load, but the user may set the filter characteristics according to the installation conditions of acoustic device 200. It is generally recommended that acoustic reproducers such as woofers and actuators that reproduce bass band signals be installed on a hard object in a non-slip state. This is because when a woofer, an actuator, or the like moves due to its own vibration, energy is wasted by the movement, and the diaphragm that emits sound weakens the force that pushes air. However, the woofer, actuator, or the like are not always installed in the recommended places mentioned above depending on the housing situation, the taste of the interior, and the like. For example, in the case of an apartment house or the like, in consideration of vibration to the surroundings, there is even a case where an acoustic reproducer for a bass range is installed rather on a soft material. Other than such a case, it can be installed on a variety of materials, such as on a carpet, on a table with a tablecloth, on a tatami mat, or on a concrete flooring. The frequency characteristics may change depending on the material used at the installation location of second acoustic reproducer 112. Here, the relationship between the frequency characteristics of second acoustic reproducer 112 and the hardness of the material will be described with reference to FIG. 16A. FIG. 16A is a conceptual diagram showing the relationship between the hardness of the material used at the installation location and the frequency characteristics of the vibration caused by actuator 115.

As shown in FIG. 16A, the frequency characteristics of the vibration by actuator 115 may change depending on the hardness of the material used at the installation location.

Then, setter 250 may have an operating means for setting the filter characteristics. An example of such an operating means will be described with reference to FIG. 16B. FIG. 16B is a diagram showing an example of the operating means included in setter 250 according to the present embodiment. Setter 250 may have, for example, a knob shown in FIG. 16B. The filter characteristics may be changed according to the position (rotation angle) of such a knob. Specifically, setter 250 may have a table in which the position of the knob corresponding to the type of material used at the installation location is associated with each filter characteristic, and the filter characteristic may be able to be changed by changing the position of the knob. Here, such a table will be described with reference to FIG. 16C. FIG. 16C is a diagram showing an example of a table included in setter 250 according to the present embodiment. By setting the filter characteristics based on the table as shown in FIG. 16C by setter 250, it is possible to realize the filter characteristics according to the installation location.

With this, the user can set the filter characteristics to be suitable for the material used at the installation location by using setter 250. It should be noted that in the example shown in FIG. 16B and FIG. 16C, the positions that can be set with the knob have 5 steps from 0 to 4, and the filter characteristics corresponding to the respective positions are stored in the table, but an intermediate value between the two steps may be able to be set by the knob, and in that case, the filter characteristics to be set may be inferred from the filter characteristics in the vicinity of the value by interpolation or the like.

It should be noted that the operating means included in setter 250 is not limited to the knob. For example, it may be a button or the like, or it may be a touch display or the like.

Figure 17:
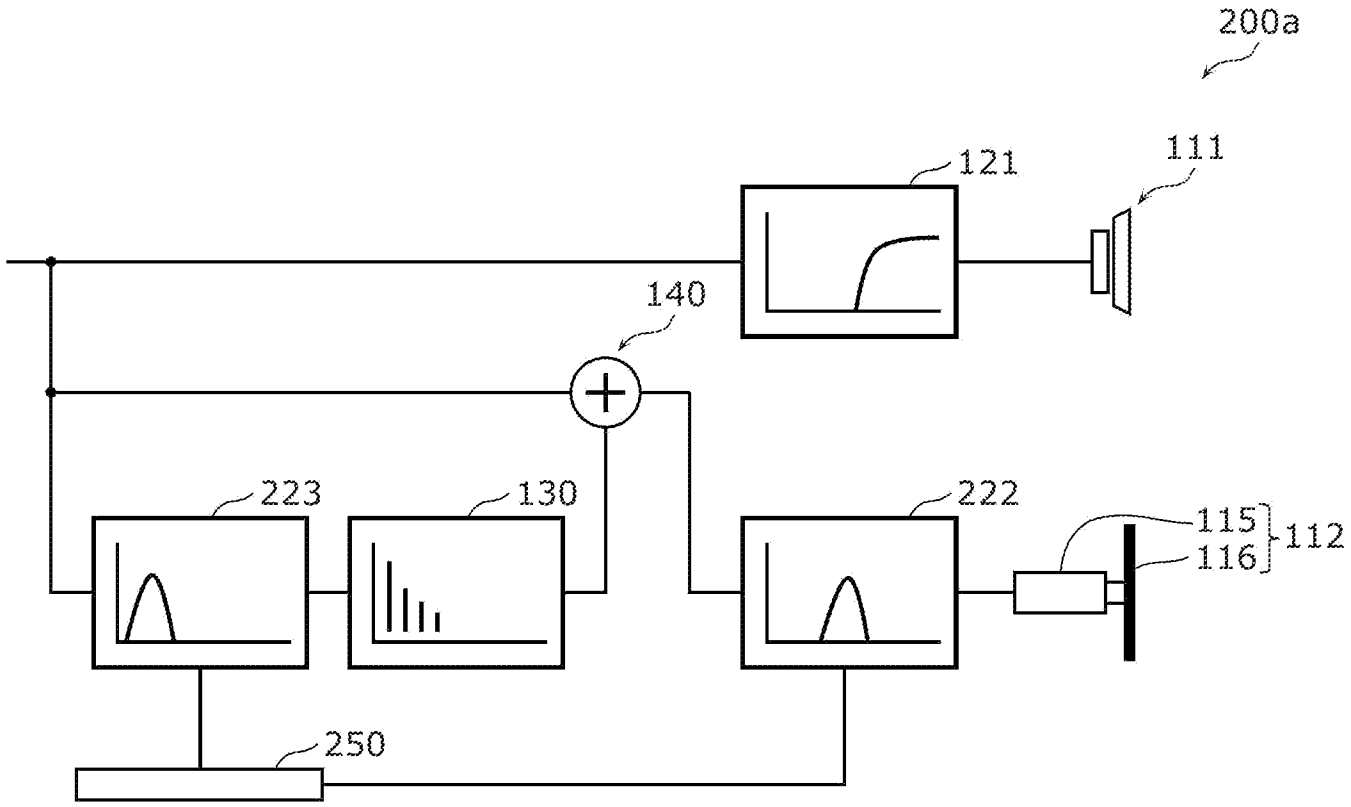
FIG. 17 is a block diagram showing a configuration of an acoustic device according to Variation 1 of Embodiment 2.

It should be noted that setter 250 may be applied to, for example, acoustic device 100*b* according to Variation 2 of Embodiment 1. The configuration of such an acoustic device will be described with reference to FIG. 17. FIG. 17 is a block diagram showing the configuration of acoustic device 200*a* according to Variation 1 of the present embodiment. Acoustic device 200*a* having such a configuration can also achieve the same effect as acoustic device 200.

(Variations, etc.)

The acoustic device and acoustic reproduction method according to the present disclosure have been described above based on each embodiment, but the present disclosure is not limited to these embodiments. A form obtained by applying various variations that a person skilled in the art can conceive to the embodiments, and a form realized by combining the constituent elements in different embodiments without departing from the spirit of the present disclosure are also included in this disclosure. Forms in which various modifications that can be conceived by those skilled in the art are applied to each embodiment, and other forms constructed by combining some components in each embodiment are also included in the scope of the present disclosure without departing from the spirit of the present disclosure.

For example, in acoustic device 100 according to Embodiment 1, the plurality of harmonic overtone signals may not be included in the reproduction band of first acoustic reproducer 111. In the case of having such a configuration, since all the harmonic overtone signals can be reproduced by second acoustic reproducer 112 as in the invention according to Variation 2 of Embodiment 1, the harmonic overtone signals can be reproduced without unevenness of the timbre. Therefore, it is possible to reproduce rich bass with even higher sound quality. In addition, since the harmonic overtone signal in the treble range, where the human auditory sensitivity is relatively high, is not reproduced, it is possible to suppress the perception of the harmonic overtone signal itself.

In addition, in each of the above embodiments, the first filter, the second filter, and the third filter are provided, but these filters may not necessarily be provided. For example, if a specific frequency less than the cutoff frequency on the low frequency side of the second acoustic reproducer can be extracted from the audio signal without using the third filter, the acoustic device may not include the third filter.

In addition, in each of the above embodiments, the pass bands of the filters are set so as not to overlap each other, but some of them may overlap each other, and there may be a frequency band, which is not the pass band of any of the filters, between adjacent pass bands. A part of each of the reproduction bands of the first acoustic reproducer and the second acoustic reproducer may overlap, and there may be a frequency band, which is neither of the reproduction bands, between the reproduction bands.

In addition, the forms shown below may also be included within the scope of one or more aspects of the present disclosure.

Figure 18:
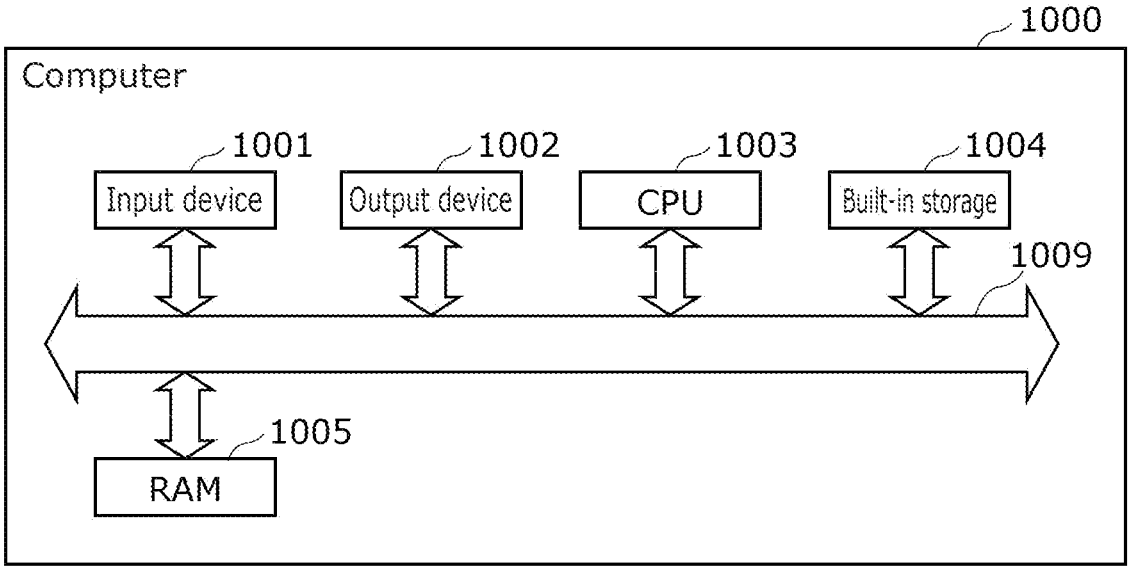
FIG. 18 is a diagram showing an example of a computer hardware configuration that realizes the functions of the acoustic device according to the present disclosure by software.

(1) The hardware configuration of the components configuring the above-described acoustic device is not particularly limited, but may be configured by, for example, a computer. An example of such a hardware configuration will be described with reference to FIG. 18. FIG. 18 is a diagram showing an example of a hardware configuration of computer 1000 that realizes the functions of the acoustic device according to the present disclosure by software.

As shown in FIG. 18, computer 1000 is a computer including input device 1001, output device 1002, CPU 1003, built-in storage 1004, RAM 1005, and bus 1009. Input device 1001, output device 1002, CPU 1003, built-in storage 1004, and RAM 1005 are connected by bus 1009.

Input device 1001 is a device that serves as a user interface such as an input button, a touch pad, and a touch panel display, and accepts user operations. It should be noted that input device 1001 may be configured to accept not only a user's contact operation, but also a voice operation and a remote operation with a remote controller or the like.

Built-in storage 1004 is a flash memory or the like. In addition, at least one of a program for realizing the function of acoustic device 100 or an application using the functional configuration of acoustic device 100 may be stored in built-in storage 1004 in advance.

RAM 1005 is a random access memory, which is used to store data or the like when executing a program or application.

CPU 1003 is a central processing unit, copies programs and applications stored in built-in storage 1004 to RAM 1005, and sequentially reads out and executes instructions included in the programs and applications from RAM 1005.

Computer 1000 may process, for example, an audio signal composed of a digital signal in the same manner as the filter, the harmonic overtone generator, and the like according to each of the above embodiments, and output the audio signal to the first acoustic reproducer and the second acoustic reproducer. In addition, computer 1000 may further include the first acoustic reproducer and the second acoustic reproducer.

(2) A part of the components configuring the above-described acoustic device may be configured by one system large scale integration (LSI). A system LSI is an ultra-multifunctional LSI manufactured by integrating a plurality of elements on a single chip, and specifically, is a computer system configured by including a microprocessor, a ROM, a RAM, and the like. A computer program is stored in the RAM. When the microprocessor operates according to the computer program, the system LSI achieves its function.

(3) A part of the components configuring the above-described acoustic device may be configured by an IC card or a single module that can be attached to and detached from each device. The IC card or the module is a computer system configured by a microprocessor, a ROM, a RAM, and the like. The IC card or the module may include the above-described super multifunctional LSI. When the microprocessor operates according to a computer program, the IC card or the module achieves its function. This IC card or this module may have tamper resistance.

(4) In addition, a part of the components configuring the above-described acoustic device may be a computer-readable recording medium, for example, a flexible disc, a hard disk, a CD-ROM, an MO, a DVD, a DVD-ROM, a DVD-RAM, a BD (Blu-ray (registered trademark) Disc), a semiconductor memory, or the like, which records the computer program or the digital signal. In addition, it may be the digital signal recorded on these recording media.

In addition, a part of the components configuring the above-described acoustic device may transmit the computer program or the digital signal via a telecommunication line, a wireless or wired communication line, a network typified by the Internet, data broadcasting, or the like.

(5) The present disclosure may be the method shown above. In addition, it may be a computer program that realizes these methods by a computer, or it may be a digital signal including the computer program.

(6) In addition, the present disclosure may be a computer system including a microprocessor and a memory, in which the memory stores the computer program, and the microprocessor operates according to the computer program.

(7) In addition, the present disclosure may be implemented by another independent computer system by recording and transferring the program or the digital signal to the recording medium, or by transferring the program or the digital signal via the network or the like.

(8) Any of the above-described embodiments and the above-described variations may be combined.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The acoustic device according to the present disclosure can be applied to a speaker in which it is impossible to secure sufficient housing capacity due to emphasis on cost and design. The acoustic device according to the present disclosure is particularly useful for flat-screen televisions, smart speakers, portable speakers, and the like, which require space-saving and high-quality bass reproduction.

The invention claimed is:

1. An acoustic device that reproduces one or more audio signals, the acoustic device comprising:

a first acoustic reproducer that reproduces a signal corresponding to a treble range among the audio signals;

a second acoustic reproducer having a reproduction band from a cutoff frequency on a low frequency side to a cutoff frequency on a high frequency side, and that reproduces a signal corresponding to a midrange lower than the treble range among the audio signals;

a harmonic overtone generator that generates a plurality of harmonic overtone signals for a fundamental tone signal corresponding to a specific frequency lower than the cutoff frequency on the low frequency side among the audio signals, a first filter that selectively passes a signal corresponding to the treble range and supplies the signal to the first acoustic reproducer;

a second filter that selectively passes a signal corresponding to the midrange and supplies the signal to the second acoustic reproducer; and a third filter that selectively passes the fundamental tone signal and supplies the signal to the harmonic overtone generator, wherein at least a part of the plurality of harmonic overtone signals is included in the reproduction band of the second acoustic reproducer, the second filter is a bandpass filter that passes a frequency twice as high as the specific frequency, and the first filter is a high-pass filter having a cutoff frequency higher than the frequency twice as high as the specific frequency.

2. The acoustic device according to claim 1, wherein the second acoustic reproducer is a woofer.

3. The acoustic device according to claim 1, wherein the second acoustic reproducer includes an actuator and a structure that holds the first acoustic reproducer driven by the actuator.

4. The acoustic device according to claim 1, further comprising:

a setter that sets frequency characteristics of the second filter and the third filter.

5. The acoustic device according to claim 1, further comprising:

a setter that sets frequency characteristics of the second filter and the third filter, wherein the second acoustic reproducer includes an actuator and a structure that holds the first acoustic reproducer driven by the actuator, and the setter sets the frequency characteristics of the second filter and the third filter according to a mass of an additional load applied to the structure.

6. The acoustic device according claim 1, wherein the plurality of harmonic overtone signals are not supplied to the first acoustic reproducer.

7. The acoustic device according claim 1, wherein the plurality of harmonic overtone signals are not included in the reproduction band of the first acoustic reproducer.

8. An acoustic reproduction method of reproducing audio signals using a first acoustic reproducer that reproduces a signal corresponding to a treble range among the audio signals, and a second acoustic reproducer having a reproduction band from a cutoff frequency on a low frequency side to a cutoff frequency on a high frequency side, and that reproduces a signal corresponding to a midrange lower than the treble range among the audio signals, the acoustic reproduction method comprising:

generating a plurality of harmonic overtone signals for a fundamental tone signal corresponding to a specific frequency lower than the cutoff frequency on the low frequency side among the audio signals;

reproducing at least a part of the plurality of harmonic overtone signals by the second acoustic reproducer;

utilizing a first filter to selectively pass a signal corresponding to the treble range and supply the signal to the first acoustic reproducer;

utilizing a second filter to selectively pass a signal corresponding to the midrange and supply the signal to the second acoustic reproducer; and utilizing a third filter to selectively pass the fundamental tone signal and supply the signal to the harmonic overtone generator, wherein the second filter is a bandpass filter that passes a frequency twice as high as the specific frequency, and the first filter is a high-pass filter having a cutoff frequency higher than the frequency twice as high as the specific frequency.

* * * * *